US010605568B2

(12) United States Patent
Curry et al.

(10) Patent No.: US 10,605,568 B2
(45) Date of Patent: Mar. 31, 2020

(54) MEASUREMENT SYSTEM

(71) Applicants: Boyd Curry, Amarillo, TX (US); Cindi Curry, Amarillo, TX (US)

(72) Inventors: Boyd Curry, Amarillo, TX (US); Cindi Curry, Amarillo, TX (US)

( * ) Notice: Subject to any disclaimer, the term of this patent is extended or adjusted under 35 U.S.C. 154(b) by 0 days.

(21) Appl. No.: 16/178,390

(22) Filed: Nov. 1, 2018

(65) Prior Publication Data

US 2019/0128645 A1 May 2, 2019

Related U.S. Application Data

(60) Provisional application No. 62/580,384, filed on Nov. 1, 2017.

(51) Int. Cl.

| | |
|---|---|
| ***F41G 1/54*** | (2006.01) |
| ***F41G 11/00*** | (2006.01) |
| ***F41G 1/387*** | (2006.01) |

(52) U.S. Cl.

CPC ..... *F41G 1/545* (2013.01); *F41G 1/387* (2013.01); *F41G 11/003* (2013.01)

(58) Field of Classification Search

CPC .... F41G 11/001; F41G 11/002; F41G 11/003; F41G 11/004; F41G 11/005; F41G 1/387

USPC ..... 42/122

See application file for complete search history.

(56) References Cited

U.S. PATENT DOCUMENTS

| | | | | |
|---|---|---|---|---|
| 7,543,405 | B1 * | 6/2009 | Ivey | F41G 11/003 42/125 |
| 8,327,574 | B2 * | 12/2012 | Sandler | F41G 11/003 42/126 |
| 8,353,125 | B2 * | 1/2013 | Riley | F41G 11/003 248/315 |
| 9,677,853 | B2 * | 6/2017 | Haugen | F41G 11/005 |
| 9,759,524 | B2 * | 9/2017 | Culp | F41G 11/003 |
| 2009/0307956 | A1 * | 12/2009 | Barret | F41G 1/38 42/125 |
| 2011/0099877 | A1 * | 5/2011 | Sandler | F41G 11/003 42/90 |
| 2012/0168589 | A1 * | 7/2012 | Riley | F41G 11/003 248/315 |
| 2012/0210624 | A1 * | 8/2012 | Schneider | F41G 11/003 42/90 |
| 2014/0096429 | A1 * | 4/2014 | Sandler | F41G 11/003 42/124 |
| 2016/0377385 | A1 * | 12/2016 | Culp | F41G 11/003 42/126 |
| 2018/0058813 | A1 * | 3/2018 | Minor | F41G 11/003 |
| 2018/0245883 | A1 * | 8/2018 | Silvennoinen | F41G 11/003 |
| 2018/0306554 | A1 * | 10/2018 | Patton | F41G 11/003 |

* cited by examiner

*Primary Examiner* — Joshua E Freeman

(74) *Attorney, Agent, or Firm* — Richard Eldridge

(57) ABSTRACT

A measurement system according the current application facilitates the positioning of scope relative to a rifle or other firearm and the subsequent measurements needed to procure a ring or set of rings with which to mount the scope to the rifle. A base is attached to a rail of the rifle and the scope is placed in a holding ring. Spacers are placed between the base and the holding ring to locate the scope. The base, spacers and holding ring are removably attached to each other.

2 Claims, 6 Drawing Sheets

MEASUREMENT SYSTEM

BACKGROUND

1. Field of the Invention

The present invention relates generally to firearms, and more specifically, to a measurement system for determining the necessary distance between a scope and the top of a firearm.

2. Description of Related Art

Firearms are well known in the art and are effective means to discharge a cartridge resulting in the projection of a bullet on a target. For example, FIG. 1 depicts a conventional rifle system 101 having a rifle 107 with a scope 109 attached to the rifle via a rail 117 and rings 115. To locate the scope 109 a user 103 must measure with a measuring tape 105, scale or the like to determine the proper height for rings 115.

One of the problems commonly associated with system 101 is its limited efficiency. For example, the measurements needed to request the proper rings are non-liner resulting in measurement errors. This results in the scope 109 being too high or too low for the user 103 to look through. Other common problems include users 103 purchasing the wrong rings 115 because no measurements were taken.

Accordingly, although great strides have been made in the area of rifle systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
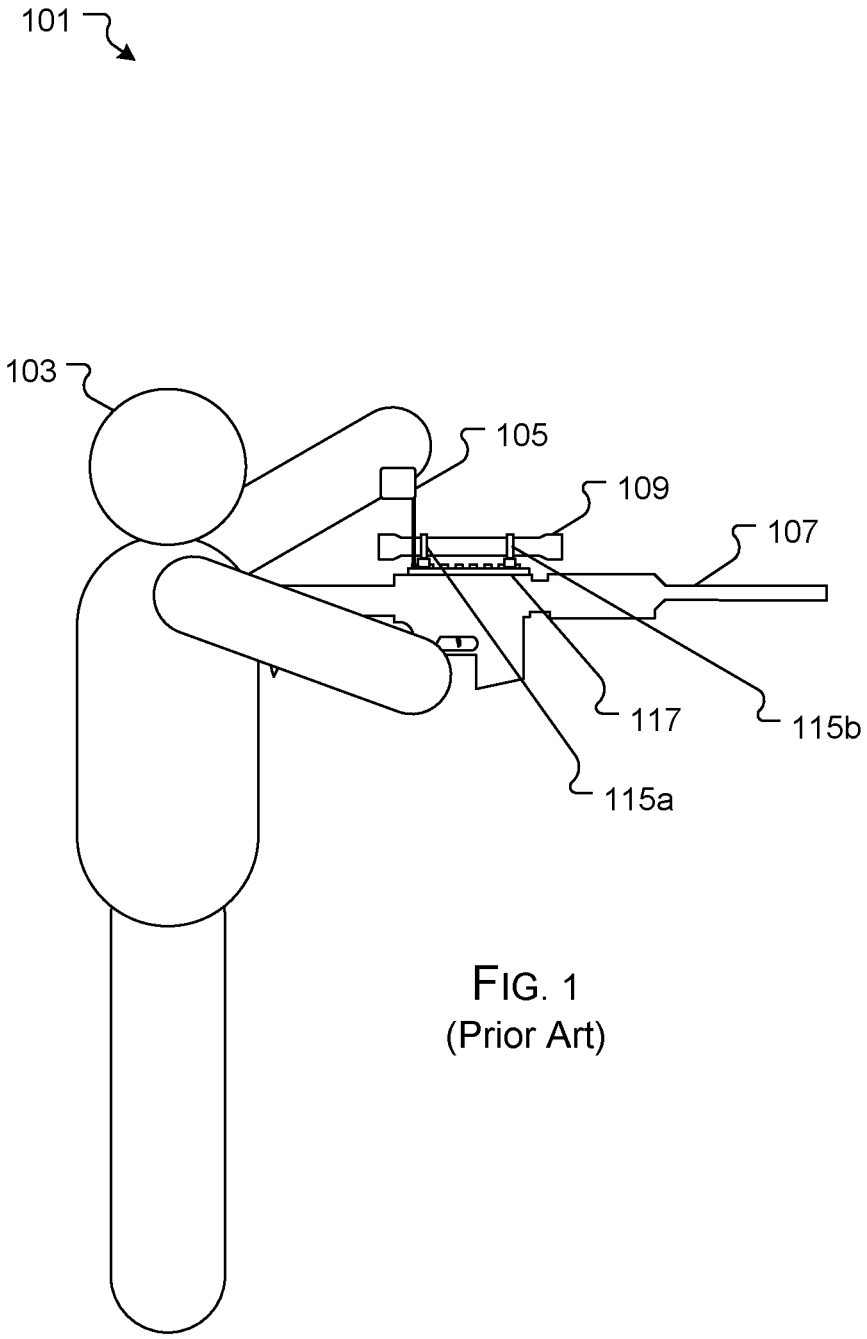
FIG. 1 (Prior Art)
FIG. 1 is a side view of a common rife system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional rifle systems. Specifically, the invention of the present application facilitates accurate measurements to select the correct rings to mount a scope to a rifle with. Additionally, the invention of the present application simplifies the process of obtaining these measurements so as not to discourage users from taking the measurements. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
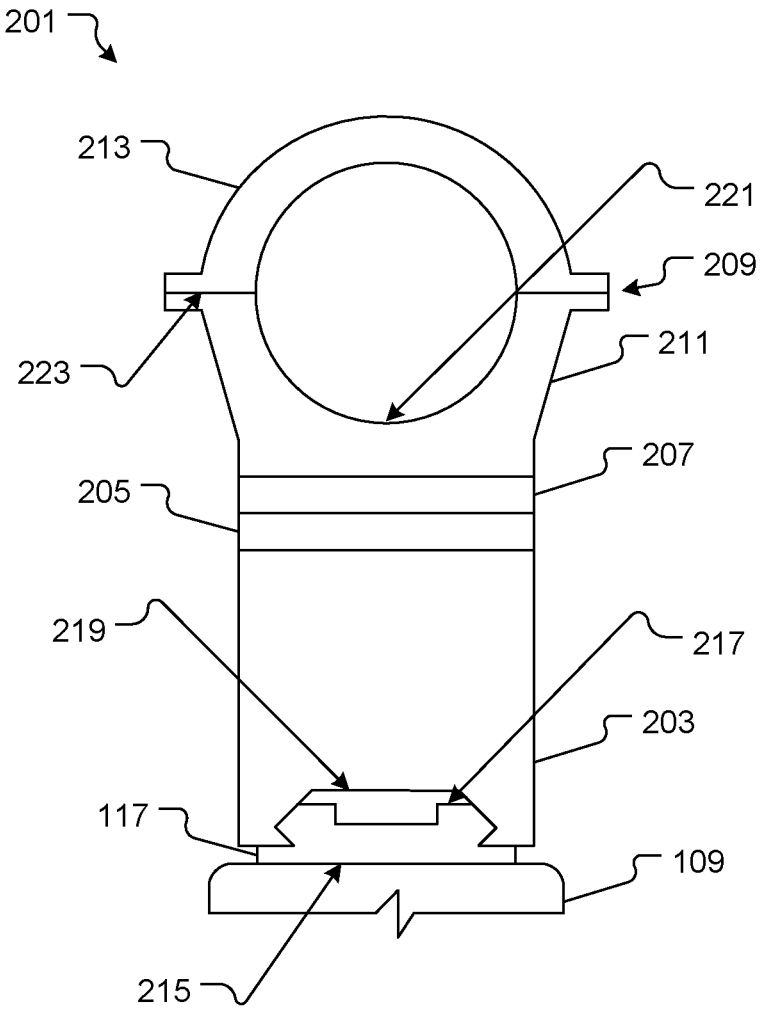
FIG. 2 is a back view of a measurement system in accordance with a preferred embodiment of the present application.

Referring now to the drawings wherein like reference characters identify corresponding or similar elements throughout the several views, FIG. 2 depicts a front view of a measurement system in accordance with a preferred embodiment of the present application. It will be appreciated that system 201 overcomes one of more of the above-listed problems commonly associated with conventional rifle systems.

In the contemplated embodiment, system 201 includes a base 203 configured to attach to the rail 117 of rifle 109. There are common rails 117 in the art of firearms such as Dovetail, Picatinny, KeyMod or M-LOK, and it is contemplated that base 203 will attach to at least one of these. The base 203 having a first spacer 205 and a second spacer 207 stacked atop each other. The second spacer 207 having a holding ring 209 stacked above it. It is contemplated that the first 205 and second 207 spacers and the holding ring 209 are removable attached to each other. The holding ring 209 having a lower 211 and upper 213 section that hold a scope 109 (not shown) between them.

In use the base 203 is attached to a rifle 107 via rail 117. The scope 109 is placed between the lower 211 and upper 213 sections of holding ring 209. Spacers 205, 207 are placed between the base 203 and ring 209 to adjust the location of the scope 109. When the scope 109 is located properly measurements required to select the proper rings 115 are taken. The scope 109 is removed to further facilitate the measurements providing a plane in which the distance between key points 215, 217, 219, 221, 223 can be ascertained.

It should be appreciated that one of the unique features believed characteristic of the present application is that a variable number of spacers 205, 207 can be quickly added to properly locate the scope 109. It will further be appreciated that ring 115 manufactures require different measurements to select rings 115 and that system 201 clearly marks such key points as the center of the scope 223.

Figure 3:
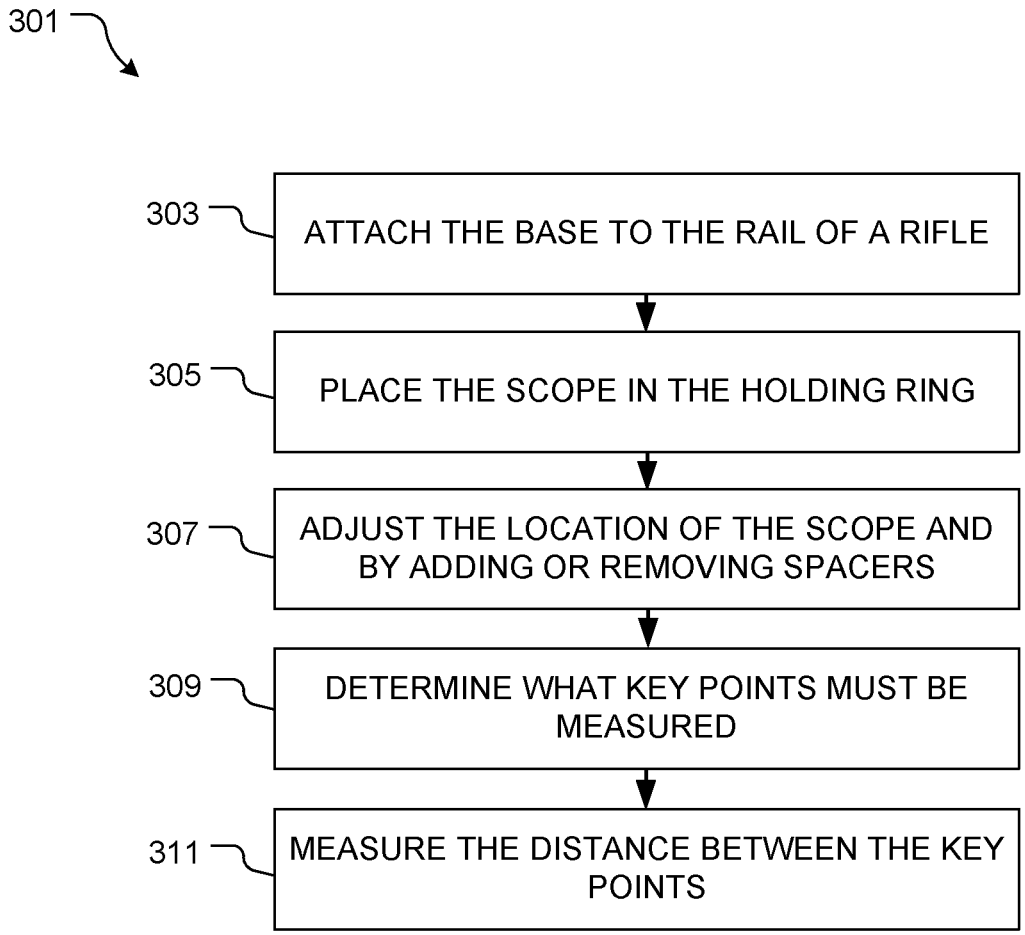
FIG. 3 is a flowchart of the preferred method of use of the system of FIG. 2.

Referring now to FIG. 3 the preferred method of use of system 201 is depicted. Method 301 including attaching the base to the rail of a rifle 303, placing the scope in the holding ring 305, adjusting the location of the scope by adding or removing spacers between the base and holding ring 307, determining what key points must be measured to order rings 309 and measuring the distance between the determined key points 311.

Figure 4:
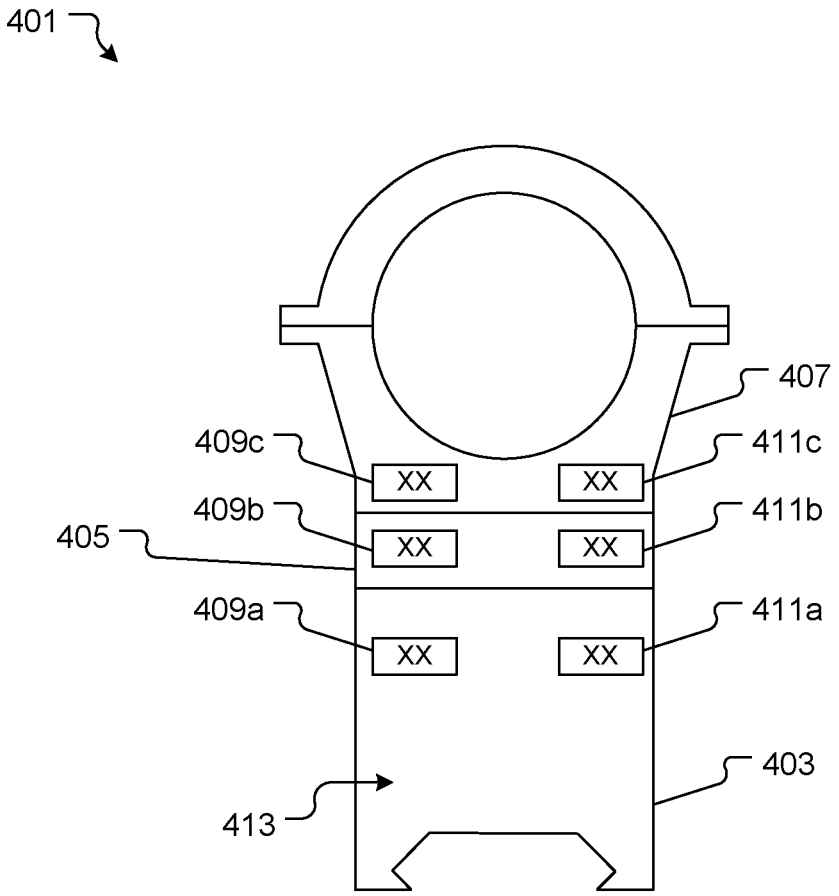
FIG. 4 is a back view of an alternative embodiment of the system of FIG. 2.

Referring now to FIG. 4 an alternative embodiment of the system 201 is depicted. Embodiment 401 including a base 403 and holding ring 407 having a spacer 405 between. Each having a first indicia 409 and second indicia 411 attached to an outer surface 413. It is contemplated that the indicia 409, 411 are the measurement of the respective base 403, spacer 405 or ring 407 for a different manufacturer of rings 115. It will thus be appreciated that by summing either the first indicia 409 or second indicia 411 provides the measurements of key points without manually measuring them.

Figure 5:
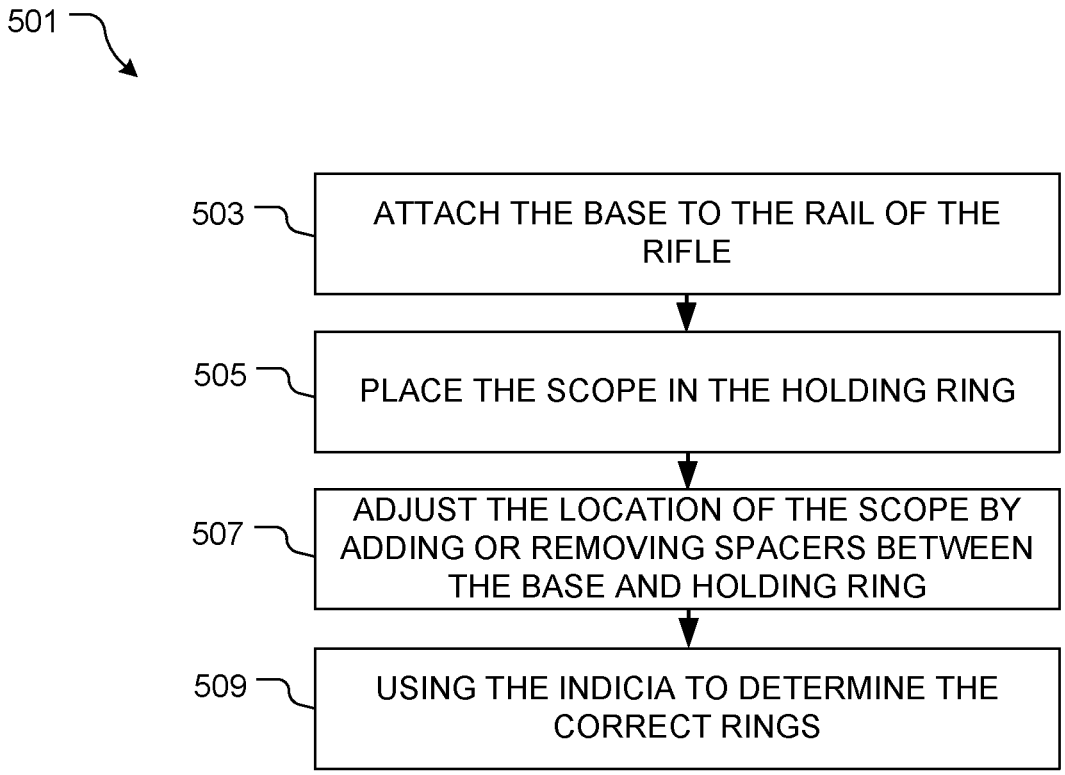
FIG. 5 is a flow chart of the preferred method of use of the embodiment of FIG. 4.

Referring now to FIG. 5 the preferred method of use of the embodiment 401 is depicted. Method 501 including attaching the base to the rail of a rifle 503, placing the scope in the holding ring 505, adjusting the location of the scope by adding or removing spacers between the base and holding ring 507 and using the indicia to determine the correct rings to use 509.

Figure 6:
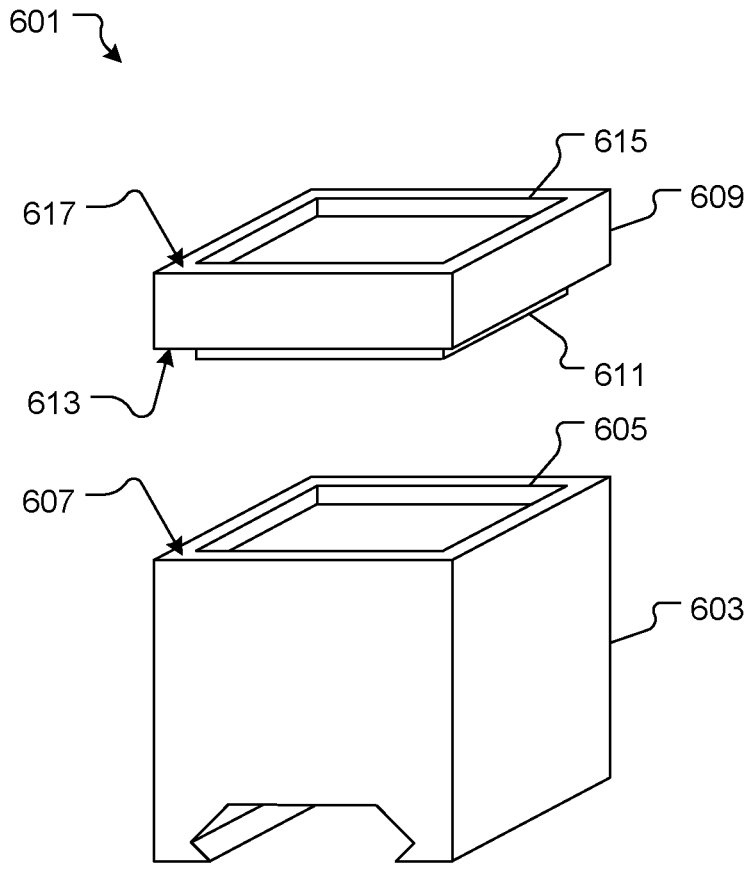
FIG. 6 is an exploded perspective view of the base and spacers of FIGS. 2 and 4.

Referring now to FIG. 6 a base and spacer of either system 201 or 401 is depicted. In the current embodiments it will be appreciated that the base, spacers and holding ring are removably attached to each other. In the current embodiment 601 a base 603 has a pocket 605 extending inward from the top surface 607. A spacer 609 having a protrusion 611 extending out and away from the bottom surface 613 and a pocket 615 extending inward from the top surface 617. The protrusion 611 configured to form an interference fit with pocket 605. It will be understood that additional spacers and the holding ring will also attach in a similar fashion. While the protrusion/pocket attachment method is depicted other are contemplated.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A measurement system comprising:

a rectangular shaped base configured to attached to a rail of firearm, the base extending from a first end to a second end, the first end is configured to engage with the rail of the firearm, the base having:

a base pocket extending inwardly from a top surface of the second end; and a measurement base indicia secured to an outside surface of the base;

a holding ring having:

an upper section and a lower section between which a scope is temporarily secured, and a measurement holding ring indicia secured to an outer surface of the holding ring; and a rectangular shaped spacer extending from a top end to a bottom end, the spacer having:

a rectangular shaped protrusion extending from a spacer bottom surface of the bottom end, the protrusion is configured to fit within the base pocket;

a spacer pocket extending inwardly from a spacer top surface of the top end, the spacer pocket is configured to engage with the holding ring; and a measurement spacer indicia secured to a surface of the spacer;

wherein the holding ring is removably attached to the top of the base; and wherein the spacers are removably attached between the base and holding ring.

2. The system of claim 1 wherein the base, the spacer, and the holding ring have indicia attached to at least one outer surface that facilitate determine the measurements required to select a set of rings from a ring manufacturer.

* * * * *